United States Patent [19]

Mutsuo

[11] Patent Number: 4,912,821

[45] Date of Patent: Apr. 3, 1990

[54] METHOD OF FORMING CRIMPS IN HIGH TENSILE MODULUS FILAMENTS

[75] Inventor: Katsu Mutsuo, Iwakuni, Japan

[73] Assignee: Teijin Limited, Osaka, Japan

[21] Appl. No.: 298,661

[22] Filed: Jan. 18, 1989

[30] Foreign Application Priority Data

Jan. 22, 1988 [JP] Japan ..... 63-10949

[51] Int. Cl.[4] ..... D02G 1/00; D02G 1/12

[52] U.S. Cl. ..... 28/265; 28/221; 28/263; 428/370

[58] Field of Search ..... 28/265, 221, 262, 263; 428/370, 369, 371

[56] References Cited

U.S. PATENT DOCUMENTS

| | | | |
|---|---|---|---|
| 2,931,091 | 4/1960 | Breen | 428/370 |
| 3,038,236 | 6/1962 | Breen | 428/370 |
| 3,038,237 | 6/1962 | Taylor | 428/370 |
| 3,298,079 | 1/1967 | Agett et al. | 28/221 |
| 3,439,394 | 4/1969 | Gray et al. | 28/221 |
| 3,578,551 | 5/1971 | Gray et al. | 28/263 |
| 3,892,021 | 7/1975 | Izawa et al. | 28/265 |
| 4,299,015 | 11/1981 | Marcus et al. | 28/221 |

FOREIGN PATENT DOCUMENTS

| | | | |
|---|---|---|---|
| 768961 | 10/1967 | Canada | 428/370 |
| 806088 | 2/1969 | Canada | 428/370 |

*Primary Examiner*—Andrew M. Falik
*Assistant Examiner*—Bibho R. Mohanty
*Attorney, Agent, or Firm*—Burgess, Ryan and Wayne

[57] ABSTRACT

Satisfactory crimps are formed in high tensile modulus filaments having a tensile modulus of elasticity of 5,000 kg/mm$^2$ or more by mixing the high tensile modulus filaments with additional filaments having a tensile modulus of elasticity of 3,000 kg/mm$^2$ or less, and compression crimping the mixed filaments.

11 Claims, 1 Drawing Sheet

METHOD OF FORMING CRIMPS IN HIGH TENSILE MODULUS FILAMENTS

BACKGROUND OF THE INVENTION (1) Field of the Invention

The present invention relates to a method of forming crimps in high tensile modulus filaments. More particularly, the present invention relates to a method of forming crimp in artificial filaments having a high tensile modulus of elasticity of 5,000 kg/mm$^2$ or more, by a compression crimping procedure, to provide crimped high tensile modulus filaments which can be connected to staple fibers having an enhanced spinning property.

(2) Description of the Related Arts

It is known that artificial crimps can be imported to artificial filaments by a compression crimping method or a gear crimping method. It is also known that, from the view point of productivity, the compression crimping method using a stuffing box is best utilized, and accordingly, attempts have been made to crimp artificial high tensile modulus filaments, for example, paratype aramide filaments having a tensile modulus of elasticity of 7100 kg/mm$^2$, by the compression crimping method using the stuffing box.

Where the compression crimping procedure is applied to a tow of the high tensile modulus filaments in a compression crimping apparatus, it is often found that, a short time after the start of the crimping procedure, the bundling condition of the filament tow supplied to the crimping apparatus is in disorder and at the same time, shaking of the crimping apparatus occurs, and thus the crimping procedure cannot be continued. Also, the resultant crimped filaments have unsatisfactory crimping properties, and thus are not practically usable.

Where the same crimping procedure as mentioned above was applied to other high tensile modulus filaments, for example, steel filaments having a tensile modulus of elasticity of 20,000 kg/mm$^2$ and glass filaments having a tensile modulus of elasticity of 7,000 kg/mm$^2$ shaking of the crimping apparatus occurred in the same manner as mentioned above and the resultant crimped filaments exhibited unsatisfactory crimping properties.

When the crimped high tensile modulus filaments were subjected to a spinning procedure in the form of staple fibers, it was found that a lap of the fibers was wound around a carding roll, and thus the spinning procedure could not be continued.

Accordingly, the provision of an effective method of imparting satisfactory crimps to high tensile modulus filaments by using a compression crimping apparatus is strongly desired.

SUMMARY OF THE INVENTION

An object of the present invention is to provide a method of forming crimps in high tensile modulus filaments, at a high efficiency and productivity.

Another object of the present invention is to provide a method of forming crimps in high tensile modulus filaments, which method can be continuously carried out by using a compression crimping apparatus, without shaking of the apparatus and disorder of the filaments.

A further object of the present invention is to provide crimped high tensile modulus filaments having satisfactory stable crimps and usable for producing high tensile modulus staple fibers having an enhanced spinning property.

The above-mentioned objects are attained by the method of the present invention comprising the steps of mixing a plurality of high tensile modulus filaments having a tensile modulus of elasticity of 5,000 kg/mm$^2$ or more with a plurality of additional filaments having a tensile modulus of elasticity of 3,000 kg/mm$^2$ or less; and compression crimping the resultant mixed filaments.

DESCRIPTION OF THE PREFERRED EMBODIMENTS

Figure 1:
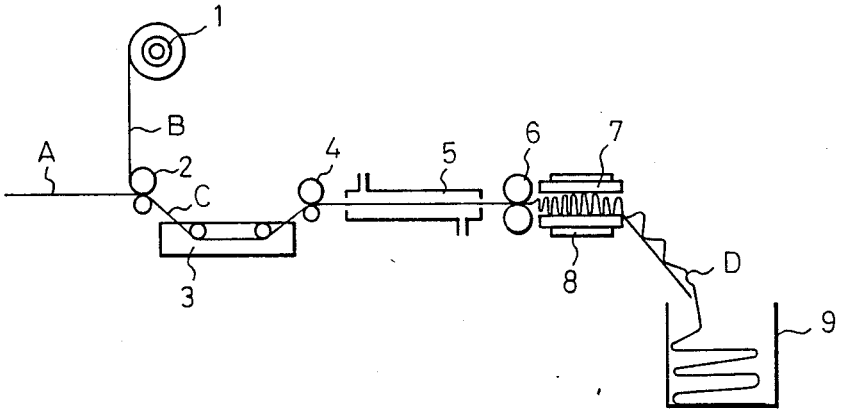
FIG. 1 is an explanatory view of an embodiment of the apparatus for effecting the method of the present invention; and, FIG. 2 is an explanatory view of an embodiment of the apparatus for separating crimped high tensile modulus filaments, in a mixture of crimped filaments, from crimped additional filaments therein.

In the present invention, it was found that the additional filaments having a tensile modulus of elasticity of 3000 kg/mm$^2$ or less and mixed with the high tensile modulus filaments having a tensile modulus of elasticity of 5,000 kg/mm$^2$ or more, are effective for imparting satisfactorily stable crimps to the high tensile modulus filaments under crimping conditions in which the high tensile modulus filaments cannot be satisfactorily crimped in the absence of the additional filaments.

The high tensile modulus filaments usable for the present invention are preferably selected from the group consisting of poly-p-phenylene-terephthalamide filaments, for example, those available under the trademark of Kevlar, made by Du Pont; copoly-p-phenylene/3,4'-oxydiphenylene terephthalate filaments, for example, those available under the trademark of Technola, made by Teijin Ltd; glass filament and steel filaments having a tensile modulus of elasticity of 5,000 kg/mm$^2$ or more; and mixtures of at least two types of the above-mentioned filaments.

The additional filaments usable for the present invention are preferably selected from the group consisting of viscose rayon filaments, cupra rayon filaments, aliphatic polyamide filaments, for example, nylon 6 and nylon 66 filaments, polyacrylic filaments, polyester filaments, for example, polyethylene terephthalate filaments, water-insoluble modified polyvinyl alcohol filaments, poly-m-phenylene isophthalamide filaments and polybenzimidazole filaments having a tensile modulus of elasticity of 3,000 kg/mm$^2$ or less, and mixtures of at least two types of the above-mentioned filaments.

In the method of the present invention, a plurality of the high tensile modulus filaments is mixed with a plurality of the additional filaments to provide the mixed filaments to be crimped.

In the mixed filaments, the content of the additional filaments is preferably 40% to 98% by weight, more preferably 60% to 98% by weight.

When the content of the additional filaments in the mixed filaments is more than 98% by weight (the content of the high tensile modulus filaments is less than 2% by weight) the amount of the resultant crimped high tensile modulus filaments is very small, and therefore, when the crimped high tensile modulus filaments are separated from the additional filaments, a very small yield of the separated crimped high tensile modulus filaments is obtained, and thus the process is very costly. Also, when the crimped mixed filaments are used without the separation, for example, for the preparation of mixed staple fibers to be converted to spun yarns, the contribution of the crimped high tensile modulus staple fibers to various properties, for example, tensile strength, of the spun yarns is unsatisfactory.

When the content of the addition filaments in the mixed filaments is less than 40% by weight, the contribution of the additional filaments to the formation of crimps in the high tensile modulus filaments is unsatisfactory.

The high tensile modulus filaments and the additional filaments to be used for the method of the present invention preferably have a denier of the individual filament of from 0.5 to 10.

The mixed filaments are subjected to a compression crimping procedure, preferably by using a stuffing box. Before the compression crimping procedure, the mixed filaments are preferably conditioned at a temperature of from 60° C. to 100° C. and in an average moisture content of 10% by weight or more.

The temperature of 60° C. to 100° C. imparted to the mixed filaments under wet condition effectively decreases the Young's modulus of the additional filaments, to promote the compression buckling of the filaments and thus the formation of crimps therein, and to form acute compression buckling angles of the filaments.

The moisture content of 10% by weight or more is effective not only for swelling the filaments to cause a decrease of the secondary transition point and the Young's modulus of the filament, but also for promoting the bundling of the mixed filaments and stability of the crimping procedure applied to the mixed filaments.

Generally, the mixed filaments are in the form of a tow, and the tow of mixed filaments preferably has a total denier of 40,000 per 25 mm of the width of a feed nip roller through which the tow is fed into the compression crimping apparatus. An excessively small total denier of the tow sometimes causes an undesirable shaking of the compression crimping apparatus.

Usually, the tow of the mixed filaments is fed to the compression crimping apparatus at a speed of 5 to 300 m/min, but this is variable depending on the type and thickness of the filaments in the tow.

In the compression crimping apparatus, the mixed filaments are compression buckled to form crimps therein, and preferably, heat-set at a temperature of 80° C. or more, more preferably 100° C. or more, still more preferably 100° C. to 180° C., at which the filaments are not fuse-bonded to each other, and the moisture retained in the mixed filaments is evaporated as quickly as possible.

If the compression buckling angles imparted to the mixed filaments increase during the compression crimping procedure, the resultant crimps on the mixed filaments are unsatisfactory. Therefore, to prevent an increase in the buckling angles of the mixed filaments, preferably the mixed filaments in the compression crimping apparatus are heat-set at a packing density of 0.5 g/cm$^2$ or more.

The method of the present invention will be further explained with reference to FIG. 1.

Referring to FIG. 1, a tow A of additional filaments having a tensile modulus of elasticity of 3000 kg/mm$^2$ or less is mixed at a pair of feed rollers 2 with a tow B of high tensile modulus filaments supplied from a roll 1, to form a mixed filament tow C. The mixed filament tow C is oiled in an oiling bath 3, squeezed by a pair of nip rollers 4, and then conditioned by steam in a conditioning box 5 at a predetermined temperature and a predetermined moisture content. The conditioned mixed filament tow C is fed through a pair of pushing rollers 6 into a compression crimping box, for example, a stuffing box 7, equipped with a heater 8. The mixed filaments are packed at a packing density of 0.5 g/cm$^2$ or more, compression buckled in the stuffing box 7 to form crimps therein, and heat set at a temperature of 80° C. or more by the heater 8.

The resultant crimped mixed filament tow D is delivered to a can 9.

The procedure of mixing the high tensile modulus filament tow B with the additional filament tow A can be effected at any point upstream of the pushing rollers 6, but since it is preferable to apply the conditioning procedure to the mixed filament tow C before the compression crimping procedure, the mixing procedure is preferably effected at any point upstream of the conditioning box 5.

The mixing procedure is not limited, but preferably the high tensile modulus filaments are evenly mixed with the additional filaments so that, in a transverse view of the resultant mixed filament tow, the high tensile modulus filaments are evenly distributed in the mixed filament tow. This even mixing effectively prevents the generation of shaking of the compression crimping apparatus.

The oiling procedure in the oiling bath 3 effectively imparts predetermined amounts of an oiling agent and water to the mixed filaments. The oiling agent usable for the method of the present invention can be selected from usual oiling agents for staple fibers to be spun or to be converted to a non-woven fabric by a dry webbing method.

The oiling agent and the moisture imparted to the mixed filaments contribute to a stabilizing of the compression crimping procedure.

As stated above, the average moisture content of the mixed filaments is preferably 10% by weight or more, more preferably 10% to 30% by weight.

The compression crimping procedure is carried out so that crimps are formed in the high tensile modulus filaments, preferably at a number of 10 crimps/25 mm or more and at a crimp percentage of 10% or more.

The resultant crimped mixed filaments composed of the high tensile modulus filaments and the additional filaments can be used without separation. Namely, when the mixed crimped mixed filaments are cut to a predetermined length, the resultant crimped mixed staple (short) fibers can be used to provide non-woven fabrics or spun yarns.

Alternatively, the crimped high tensile modulus filaments in the mixed filaments are separated from the crimped additional filaments, and the separated crimped high tensile modulus filaments and additional filaments are then cut separately to predetermined lengths. The length of the resultant cut filaments is usually from 32 to 153 mm. The cut high tensile modulus filaments and additional filaments are separately subjected to predetermined uses, for example, spun yarns or non-woven fabrics by a dry webbing method.

The separation of the high tensile modulus filaments from the additional filaments can be effected by any separating apparatus.

Figure 2:
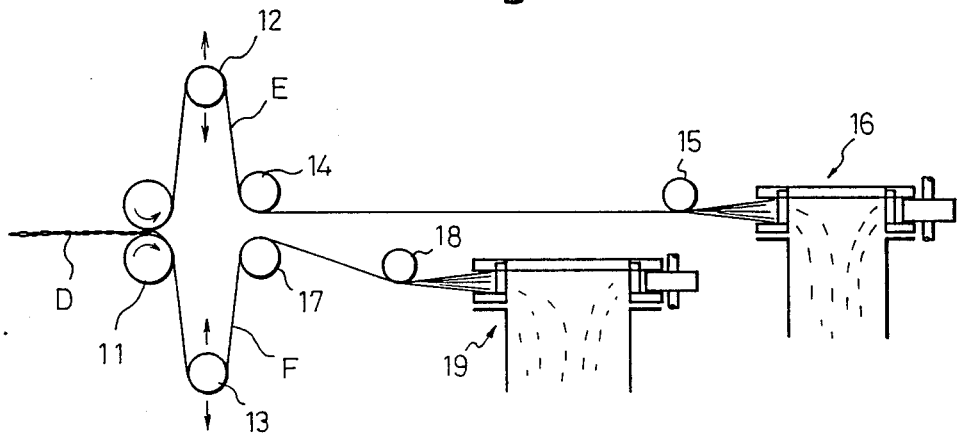

Referring to FIG. 2, which shows an embodiment of the filament-separating apparatus, a crimped mixed filament tow D is fed through a pair of feed rollers 11 and divided into a tow E of crimped high tensile modulus filaments and a tow F of crimped additional filaments, respectively, through a swing roller 12 and a swing roller 13, which are vertically movable in the direction shown by arrows. The separated high tensile modulus filament tow E is taken up to a cutter 16 through guide rollers 14 and 15 and cut by the cutter 16 to a predetermined length to provide crimped high tensile modulus stable fibers.

The additional filament tow F is taken up to a cutter 19 through guide rollers 17 and 18 and cut by the cutter 17 to a predetermined length.

To smoothly separate the crimped high tensile modulus filament tow E from the crimped additional filament tow F, preferably the taking-up speeds of the tows E and F to the cutters 16 and 19 are controlled to a level slightly higher than the feeding speed thereof to the feed roller 11. The taking-up speeds of the tows E and F to the cutters 16 and 19 are respectively controlled in accordance with the tensions of the tows on the swing rollers 12 and 13. Namely, the tensions created on the tows E and F can be controlled by controlling the taking-up speeds of the tows E and F into the cutters 16 and 19, respectively.

If the numbers of crimps in the crimped mixed filaments are less than 10 crimps/25 mm, and/or the crimp percentages thereof are less than 10%, they cannot be always satisfactory opened in the scotching and carding procedures, and thus cannot be evenly mixed with each other. Therefore, the resultant mixed spun yarns have an uneven composition, structure, and properties thereof.

Also, if the separated crimped high tensile modulus filaments have less than 10 crimps/25 mm and/or a crimp percentage of less than 10%, the filaments cannot be satisfactorily opened in the scotching and carding procedures, the filaments are often wound around the carding cylinder, and a large amount of fiber dust is formed in the carding procedure so that the spinning procedures must be often interrupted.

The crimped high tensile modulus filaments produced in accordance with the method of the present invention have similar crimping properties to those of usual filaments having a relatively low tensile modulus and can be used independently or together with ordinary relatively low tensile modulus filaments, without difficulty, to provide spun yarns or non-woven fabrics.

EXAMPLES

The present invention will be further explained by way of specific examples, which are representative and do not in any way restrict the scope of the present invention.

Example 1 and Comparative Example 1

In Example 1, a tow A of additional filaments was prepared from 163,900 poly-m-phenylene isothalamide filaments available under a trademark of Teijinconex, made by Teijin Ltd., produced through wet-spinning, drawing, and heat-setting procedures, having a denier of the individual filaments of 1.5 and a tensile modulus of elasticity of 990 kg/mm$^2$, and oiled with an oiling agent.

A tow B of crimped high tensile modulus filaments was provided from 70,000 copoly-p-phenylene/3,4'-oxydiphenylene terephthalamide filaments available under a trademark of Technola, made by Teijin Ltd., and having a tensile modulus of elasticity of 7100 kg/mm$^2$ and a denier of individual filaments of 1.5.

The tow A in an amount of 70 parts by weight was evenly mixed with 30 parts by weight of the tow B to provide a mixed filament tow having a total denier of 350,000, and the mixed filament tow then oiled with a conventional oiling agent. The mixed and oiled filament tow was conditioned at a temperature of 75° C. and a moisture content of 12%, fed to a compression crimping machine equipped with a pair of feed rollers having an effective width of 100 mm, and compression-crimped at a crimping speed of 20 m/min at a temperature of 95° C. and a packing density of 0.84 g/cm$^3$. The crimped mixed filament tow was cut to a length of 51 mm, and the resultant cut high tensile modulus filaments (Technola) and additional filament (Teijinconex) had the crimping properties as shown in Table 1.

The compression crimping procedure was continuously and stably carried out for 24 hours. During the 24 hour continuous operation, shaking occurred only once in the compression crimping apparatus.

TABLE 1

(Example 1)

| Filament | Item | Content (% wt.) | Number of crimps per 25 mm | Crimp percentage (%) |
|---|---|---|---|---|
| High tensile modulus (Technola) | filaments | 30 | 11.2 | 15.3 |
| Additional filaments (Teijinconex | | 70 | 11.4 | 16.1 |

In Comparative Example 1, the same procedures as in Example 1 were carried out except that additional filaments were not added and the total denier of the high tensile modulus filament tow was adjusted to 350,000.

The resultant crimped high tensile modulus fibers had a length of 51 mm and the unsatisfactory crimping properties shown in Table 2.

The crimping step was unstable and one minute after the state of the crimping step, shaking of the apparatus occurred.

TABLE 2

(Comparative Example 1)

| Filament | Item | Content (% wt) | Number of crimps per 25 mm | Crimp percentage (%) |
|---|---|---|---|---|
| High tensile modulus (Technola) | filaments | 100 | 8.1 | 7.2 |

Examples 2 to 4 and Comparative Example 2

In Example 2, the same procedures as those in Example 1 were carried out except that the copoly-p-phenylene/3,4'-oxydiphenylene terephthalate filaments were replaced by steel filaments having a denier of the individual filament of 2.5 and a tensile modulus of elasticity of 20,000 kg/mm$^2$.

In Example 3, the same procedures as in Example 2 were carried out except that the steel filaments were replaced by glass filaments having a denier of the individual filament of 1.7 and a tensile modulus of elasticity of 7,000 kg/mm$^2$.

In Example 4, the same procedures as in Example 2 were carried out except that the steel filaments were replaced by poly-p-phenylene terephthalamide filaments available under a trademark of Kevlar made by Du Pont, having a denier of the individual filament of 1.5 and a tensile modulus of elasticity of 5900 kg/mm$^2$.

In Comparative Example 2, the same procedures as those in Example 2 were carried out except that additional filaments were not used and the tow of the steel filaments was adjusted to a total denier of 350,000.

In each of Examples 2 to 4 and Comparative Example 2, the stability of the continuous compression crimping procedure for 24 hours was observed and evaluated in the following classes.

| Class | Note (in 24 hour continuous operation) |
|---|---|
| 5 | shaking of the apparatus generated two times or less |
| 4 | shaking of the apparatus generated 3 to 10 times |
| 3 | shaking of the apparatus generated 11 times or more |
| 2 | shaking of the apparatus generated within one minute to 5 minutes from start of crimping operation |
| 1 | shaking of the apparatus generated within one minute from start of crimping operation. |

The results are shown in Table 3.

The resultant cut high tensile modulus fibers having a length of 51 mm exhibited the crimping properties shown in Table 3.

TABLE 3

| Item Example No. | Component: High tensile modulus filament (wt %) | Component: Additional filament (wt %) | Stability of crimping operation | High tensile modulus filament: Number of crimps/25 mm | High tensile modulus filament: Crimp percentage (%) |
|---|---|---|---|---|---|
| Example 2 | Steel (30) | Teijinconex (70) | 4 | 10.3 | 13.8 |
| Example 3 | Glass (30) | Teijinconex (70) | 5 | 10.7 | 13.9 |
| Example 4 | Kevlar (30) | Teijinconex (70) | 5 | 11.0 | 14.6 |
| Comparative Example 2 | Steel (100) | — | 1 | 8.2 | 8.0 |

Examples 5 to 7 and Comparative Example 3

In Example 5, 40 parts by weight of high tensile modulus filaments consisting of copoly-p-phenylene/3,4'-oxydiphenylene terephthalamide filaments having a denier of the individual filament of 1.5 and a tensile modulus of elasticity of 7,100 kg/mm$^2$ and available under a trademark of Technola made by Teijin Ltd. were mixed with 60 parts by weight of additional filaments consisting of polyethylene terephthalate filaments produced by melt-spinning, drawing, and heat-setting procedures and having a denier of the individual filament of 2.0 and a tensile modulus of elasticity of 850 kg/mm$^2$, to provide a mixed filament tow having a total denier of 400,000.

The mixed filament tow was conditioned at a temperature of 75° C. and a moisture content of 12%, and fed to a compression crimping procedure through feed rollers having an effective width of 100 mm at a crimping speed of 30 m/min and a packing density of 0.97 g/cm$^3$.

The resultant crimped mixed filament tow was dried and relaxed at a temperature of 120° C.

The relaxed tow was divided into a crimped high tensile modulus filament tow and a crimped additional filament tow, and each tow was cut to a length of 51 mm.

The stability of the compression crimping procedure and the crimping properties of the crimped high tensile modulus filaments are shown in Table 4.

In Example 6, the same procedures as in Example 5 were carried out except that the additional filaments consisted of nylon 66 filaments drawn in two steps and having a denier of the individual filament of 2.0 and a tensile modulus of elasticity of 420 kg/mm$^2$.

The stability of the compression crimping procedure and the crimping properties of the crimped high tensile modulus filaments are shown in Table 4.

In Example 7, the same procedures as in Example 5 were carried out except that the additional filaments consisted of polyacrylic filaments produced by wet spinning, drawing and heat-setting procedures and having a denier of the individual filament of 3.0 and a tensile modulus of elasticity of 510 kg/mm$^2$.

The stability of the compression crimping procedure and the crimping properties of the resultant high tensile modulus filaments are shown in Table 4.

In Comparative Example 4, the same procedures as in Example 5 were carried out except that additional filaments were not used and the total denier of the high tensile modulus filament tow was adjusted to 400,000.

The stability of the compression crimping procedure and the crimping properties of the resultant crimped high tensile modulus filaments are shown in Table 4.

TABLE 4

| Item Example No. | Component: High tensile modulus filament (wt %) | Component: Additional filament (wt %) | Stability of crimping procedure | High tensile modulus filament (Technola): Number of crimps/25 min | High tensile modulus filament (Technola): Crimp percentage (%) |
|---|---|---|---|---|---|
| Example 5 | Technola (40) | Polyester (60) | 4 | 11.0 | 15.8 |
| Example 6 | Technola (40) | Nylon 66 (60) | 5 | 12.5 | 17.3 |
| Example 7 | Technola (40) | Polyacrylic (60) | 5 | 12.3 | 17.5 |
| Comparative | Technola | — | 1 | 7.5 | 6.6 |

TABLE 4-continued

| Item Example No. | Component: High tensile modulus filament (wt %) | Component: Additional filament (wt %) | Stability of crimping procedure | High tensile modulus filament (Technola): Number of crimps/25 min | High tensile modulus filament (Technola): Crimp percentage (%) |
|---|---|---|---|---|---|
| Example 4 | (100) | | | | |

Table 4 clearly indicates the following:

In Examples 5 to 7 in accordance with the method of the present invention, the compression crimping procedures were stably carried out and the resultant crimped high tensile modulus filaments had satisfactory crimping properties.

In Comparative Example 4, the compression crimping procedure was very unstable and the crimping properties of the resultant crimped high tensile modulus filaments were unsatisfactory.

Examples 8 to 11

In each of Examples 8 to 11, the same procedures as in Example 1 were carried out except that the mixing percentages of the high tensile modulus filaments and the additional filaments were as indicated in Table 5.

The stability of the compression crimping procedure and the crimping properties of the resultant crimped high tensile modulus filaments are shown in Table 5, in comparison with the results of Comparative Example 1.

TABLE 5

| Item Example No. | Component (wt %): High tensile modulus filament (*)1 | Component (wt %): Additional filament (*)2 | Stability of compression crimping procedure | High tensile modulus filament: Number of crimps/25 mm | High tensile modulus filament: Crimp percentage (%) |
|---|---|---|---|---|---|
| Comparative Example 1 | 100 | — | 1 | 8.1 | 7.2 |
| Example 8 | 5 | 95 | 5 | 12.2 | 17.5 |
| Example 9 | 40 | 60 | 5 | 11.1 | 15.5 |
| Example 10 | 50 | 50 | 4 | 10.8 | 14.1 |
| Example 11 | 70 | 30 | 3 | 10.3 | 13.5 |

Note:
*1 Copoly-p-phenylene/3,4'-oxydiphenylene terephthalamide filaments (Technola)
*2 Poly-m-phenylene isophthalamide filaments (Teijinconex)

Table 5 indicates that the crimping properties of the crimped high tensile modulus filaments produced in Examples 8 to 11 in accordance with the method of the present invention are superior to those of Comparative Example 1.

In view of the results of Examples 8 to 11, the crimping properties of the crimped high tensile modulus filaments decrease with an increase in the content of the high tensile modulus filaments in the mixed filaments. Especially, preferably the content of the high tensile modulus filaments in the mixed filaments is 40% by weight or less but not less than 2% by weight.

Examples 12 to 16

In each of Examples 12 to 16, a mixed filament tow having a total denier of 480,000 was prepared by mixing 10 parts by weight of high tensile modulus filaments consisting of copoly-p-phenylene/3,4'-oxydiphenylene terephthalamide filaments (Technola) having a denier of the individual filament of 1.5 and a tensile modulus of elasticity of 7,100 kg/mm$^2$ with 90 parts by weight of additional filaments consisting of poly-m-phenylene isophthalamide filaments (Teijinconex) having a denier of the individual filament of 2.0 and a tensile modulus of elasticity of 950 kg/mm$^2$.

The mixed filament tow was oiled with an oiling agent and conditioned at the temperature and moisture content indicated in Table 6, by blowing steam.

The conditioned mixed filament tow was fed to a compression crimping apparatus through a feed nip roller having an effective feed width of 120 mm and compression crimped therein at a crimping speed of 15 m/min at a packing density of 0.5 g/cm$^3$ or more and at the temperature indicated in Table 6.

The crimped mixed filament tow was cut to a length of 51 mm.

The stability of the compression crimping procedure and the crimping properties of the resultant crimped high tensile modulus filaments are indicated in Table 6.

TABLE 6

| Item Example No. | Conditioning: Moisture content (%) | Conditioning: Temperature (°C.) | Crimping temperature (°C.) | Stability of compression crimping procedure | High tensile modulus filament: Number of crimps/25 mm | High tensile modulus filament: Crimp percentage (%) |
|---|---|---|---|---|---|---|
| 12 | 8 | 50 | 60 | 3 | 11.3 | 15.0 |
| 13 | 8 | 65 | 70 | 4 | 11.8 | 16.5 |
| 14 | 12 | 65 | 70 | 5 | 12.0 | 17.1 |
| 15 | 12 | 75 | 80 | 5 | 12.5 | 18.2 |
| 16 | 12 | 75 | 95 | 5 | 12.5 | 19.0 |

Table 6 shows that the crimping properties of the crimped high tensile modulus filaments increase with increases in the moisture content and temperature of the conditioned mixed filament tow, and with an increase in the temperature of the mixed filament tow in the compression crimping apparatus. Also, the stability of the compression crimping procedure increases with increases in the moisture content and temperature of the conditioned mixed filament tow.

Example 17

The same procedures as in Example 1 were carried out, and the resultant crimped mixed filament tow was cut to provide mixed staple fibers having a length of 51 mm.

The resultant mixed staple fibers were subjected to usual spinning procedures, and it was found that, in the scotching and carding steps, the mixed staple fibers were satisfactory opened, and the amount of undesirable floating fiber dust produced in the carding step was very small. Also, the resultant spun yarns had a satisfactory uniform thickness and quality thereof.

Examples 18 and 19 and Comparative Example 4

In each of Examples 18 and 19 and Comparative Example 4, the same procedures as in Example 1 were carried out except that the crimping conditions were changed so that the resultant crimped high tensile modulus filaments had the number of crimps and the crimp percentage shown in Table 7.

The resultant crimped mixed staple fibers were subjected to usual spinning procedures.

The card-passing property of the crimped mixed staple fibers and the uniformity of the resultant sliver were evaluated as described below.

Card-passing property

A predetermined amount of the crimped mixed staple fibers were subjected to an ordinary carding procedure, at a temperature of 25° C. and a relative humidity of 55% RH, with a feeding rate of 300 grains/6 yards at a rotation rate of 14 r.p.m.

In view of the lap-licking phenomenon, winding of the fibers on the carding cylinder, the amounts of fiber dust, and drooping of the sliver, the card-passing property of the mixed fibers were evaluated in three classes; "excellent", "good", and "unsatisfactory".

Uniformity of sliver

After a drawing step, the appearance and uniformity of the resultant sliver was observed by the naked eye and evaluated in three classes; "excellent", "good" and "unsatisfactory".

The results are shown in Table 7.

TABLE 7

| Item | High tensile modulus filament | | | |
|---|---|---|---|---|
| Example No. | Number of crimps/25 mm | Crimp percentage (%) | Card-passing property | Uniformity of sliver |
| Example 18 | 11.1 | 13.2 | Excellent | Excellent |
| Example 19 | 10.3 | 10.7 | Good | Good |
| Comparative Example 4 | 9.0 | 9.4 | Unsatisfactory | Unsatisfactory |

I claim:

1. A method of producing crimped high tensile modulus filaments, comprising the steps of:

mixing a plurality of high tensile modulus filaments having a tensile modulus of elasticity of 5,000 kg/mm$^2$ or more with a plurality of additional filaments having a tensile modulus of elasticity of 3,000 kg/mm$^2$ or less; and compression crimping the resultant mixed filaments.

2. The method as claimed in claim 1, wherein the additional filaments are in a content of 40% to 98% by weight in the mixed filaments.

3. The method as claimed in claim 1, wherein the mixed filaments to be subjected to the compression crimping step are conditioned at a temperature of from 60° C. to 100° C. and an average moisture content of 10% by weight or more.

4. The method as claimed in claim 1, wherein the compression crimping step for the mixed filament is effected in a stuffing box.

5. The method as claimed in claim 4, wherein the mixed filaments in the stuffing box are heated at a temperature of 80° C. or more.

6. The method as claimed in claim 4, wherein the mixed filaments in the stuffing box are buckled and compressed at a packing density of 0.5 g/cm$^3$ or more.

7. The method as claimed in claim 1, wherein the high tensile modulus filaments are selected from the group consisting of poly-p-phenylene terephthalamide filaments, copoly-p-phenylene/3,4'-oxydiphenyleneterephthalamide filaments, glass filaments, steel filaments, and mixtures of at least two of the above-mentioned filaments.

8. The method as claimed in claim 1, wherein the additional filaments are selected from the group consisting of viscose rayon filaments, cupra rayon filaments, aliphatic polyamide filaments, polyacrylic filaments, polyester filaments, water-insoluble modified polyvinyl alcohol filaments, poly-m-phenyleneisophthalamide filaments, polybenzimidazole filaments and mixtures of at least two of the above-mentioned filaments.

9. The method as claimed in claim 1, wherein the crimped high tensile modulus filaments in the crimped mixed filaments are separated from the crimped additional filaments.

10. Crimped high tensile modulus filaments produced by the method as claimed in any of claims 1 to 9.

11. The crimped high tensile modulus filaments as claimed in claim 10, having a number of crimps of 10 crimps/25 mm or more and a crimp percentage of 10% or more.

* * * * *

UNITED STATES PATENT AND TRADEMARK OFFICE

CERTIFICATE OF CORRECTION

PATENT NO. : 4,912,821

DATED : April 3, 1990

INVENTOR(S) : Mutsuo Katsu

It is certified that error appears in the above-identified patent and that said Letters Patent is hereby corrected as shown below: On the title page:

Item [19]: change "Mutsuo" (inventor's first name) to --Katsu-- (inventor's last name).

Item [75]: change "Katsu Mutsuo, Iwakuni, Japan" to --Mutsuo Katsu, Iwakuni, Japan--.

Signed and Sealed this

Twenty-seventh Day of August, 1991

*Attest:*

*Attesting Officer*

HARRY F. MANBECK, JR.

*Commissioner of Patents and Trademarks*